US005819615A

United States Patent [19]

Dale et al.

[11] Patent Number: 5,819,615

[45] Date of Patent: Oct. 13, 1998

[54] CUTTING PROCESS

[75] Inventors: Christopher P. Dale; Derek E. Haycock, both of Northampton; David Haydock, Buckingham; Malcolm J. McBride, Northampton; Robert I. Sudding, Bedford, all of United Kingdom

[73] Assignee: Unilever Patent Holdings B.V., Vlaardingen, Netherlands

[21] Appl. No.: 889,137

[22] Filed: Jul. 7, 1997

Related U.S. Application Data

[63] Continuation of Ser. No. 534,782, Sep. 27, 1995, abandoned.

[30] Foreign Application Priority Data

Sep. 28, 1994 [EP] European Pat. Off. ..... 94307089

[51] Int. Cl.[6] ..... B26D 7/00

[52] U.S. Cl. ..... 83/13; 83/701

[58] Field of Search ..... 83/13, 701, 932, 83/870, 874

[56] References Cited

U.S. PATENT DOCUMENTS

| | | | |
|---|---|---|---|
| 2,361,288 | 10/1944 | Hardy, Jr. | 83/663 |
| 4,567,797 | 2/1986 | Folk | 83/701 X |
| 5,163,865 | 11/1992 | Smith | 83/956 X |

FOREIGN PATENT DOCUMENTS

| | | |
|---|---|---|
| 243981 | 11/1987 | European Pat. Off. . |
| 341942 | 11/1989 | European Pat. Off. . |
| 353415 | 2/1990 | European Pat. Off. . |
| 543628 | 5/1993 | European Pat. Off. . |
| 2620071 | 3/1989 | France . |
| 2504019 | 8/1976 | Germany . |
| 2743258 | 3/1979 | Germany . |
| 4232187 | 3/1994 | Germany . |
| 5-228894 | 9/1993 | Japan . |
| 2087290 | 5/1982 | United Kingdom . |
| 2246739 | 2/1992 | United Kingdom . |
| 2270025 | 3/1994 | United Kingdom . |
| 96/09919 | 4/1996 | WIPO . |

*Primary Examiner*—Maurina T. Rachuba
*Attorney, Agent, or Firm*—Pillsbury Madison & Sutro, LLP

[57] ABSTRACT

A process for cutting food products, especially brittle food products such as frozen fish. The process involves mounting a cutting blade on an ultrasonic system in a manner such that the blade is vibrated parallel to the out face and the aspect of travel of ultrasound down the blade is approximately 90° to the cutting edge of the blade. The cutting blade has a significantly blunted tip. The cutting is effected, at least in part, by localised heating of the food product. The process permits cutting of brittle food products into portions with minimum wastage. Fracturing is also reduced thus allowing the portion size to be accurately controlled and providing a final portion having smooth surfaces.

12 Claims, 3 Drawing Sheets

Fig.A. PRIOR ART
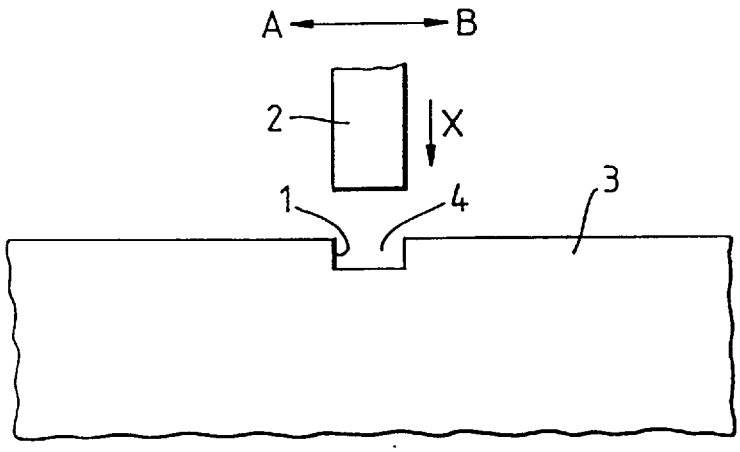
Fig.1.
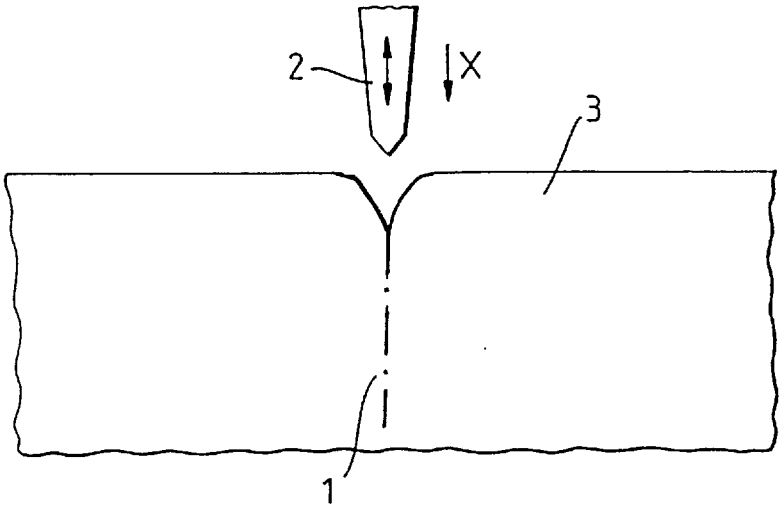

Fig.B.

PRIOR ART

CUTTING PROCESS

This is a continuation of application Ser. No. 08/534,782, filed on Sep. 27, 1995, which was abandoned upon the filing hereof Jul. 7, 1997.

TECHNICAL FIELD OF THE INVENTION

This invention relates to a process for cutting food products, in particular brittle food products such as frozen fish.

BACKGROUND OF THE INVENTION

It is highly desirable to be able to cut frozen fish into portions with a minimum loss of fish material. However, it is essential that any cutting technique used must enable the portion size being produced to be accurately controllable. This is not possible if the cutting process results in fractures being present in the food material. Furthermore the cutting technique chosen must provide a smooth surface such that the final portion can be readily battered and crumbed.

FR 2 620 071 (Mecasonic) discloses a method of ultrasonically cutting frozen food material, especially cakes, into portions in their mould. Preferably the blade is knife-shaped and has a cutting angle of 30 degrees. However, we have demonstrated that although such cutting techniques are suitable for cakes and pies, it in not a suitable technique for cutting brittle materials, such as frozen fish, because fractures result. Furthermore the blade life is very short.

EP 353 415 (Nestle) recognises the problem of cutting brittle materials and states that it is not possible to cut brittle material by conventional ultrasonic techniques because a fractured cut is achieved. EP 353 415 solves the problem of cutting brittle materials by providing a method of cutting an article involving mounting a cutting blade on an ultrasonic vibrating device in a manner such that the blade lies in a plane extending transversely to the longitudinal axis of vibration and moving said blade in said plane through said article.

In this manner the blade moves back and forth transverse to the plane in which it moves through the article, effecting a removal of the material of the article along the line of cut. In other words the blade is flexed perpendicular to the cut face as illustrated in Figure A.

This technique results in an unacceptable loss of food material.

JP 5 228 894 discloses an ultrasonic cutting device where a thin wire or blade is vibrated ultrasonically along its longest dimension. In practice this sets up a transverse vibration causing the blade to flex perpendicular to the cut surface. Furthermore the aspect of travel of the ultrasound down the blade is parallel to the cutting edge of the blade. This system has been shown to result in a rapid fatigue of the blade and may result in unacceptable lose of food material.

GB 2087290 discloses apparatus comprising a cutting tool for cutting sheet material spread on a support surface; the cutting tool is ultrasonically vibrated along an axis generally perpendicular to the support surface; this causes the sheer material to be severed by a crushing action as it is ultrasonically squeezed between the cutting surface of the cutting tool and the support surface.

The apparatus of GB 2087290 is not suitable for cutting brittle food substances since its crushing action results in fractures being formed. Furthermore, frozen fish blocks, for example, are generally too thick for the cutting tool to sever without substantial fractures forming.

Therefore, to date, it has not been possible to provide a process for cutting brittle food substances without loss of food and without forming fractures.

We have now solved this problem by use of ultrasonic cutting whereby the blade has a significantly blunted tip, the blade is vibrated parallel to the cut face as illustrated in FIG. 1 and the aspect of travel of ultrasound down the blade is approximately 90° to the cutting edge of the blade. As a result, the cutting of the food product is effected, at least in part, by localised heating of the food product.

DESCRIPTION OF THE INVENTION

Accordingly, the invention relates to a process for cutting food products involving mounting a cutting blade on an ultrasonic system in a manner such that the blade is vibrated parallel to the cut face and the aspect of travel of ultrasound down the blade is approximately 90° to the cutting edge of the blade; wherein the cutting blade has a significantly blunted tip; and wherein the cutting is effected, at least in part, by localised heating of the food product.

By significantly blunted is meant that the tip of a traditional knife-shaped blade, as illustrated by FIG. B, is blunted relative to the cutting angle by either a substantial rounding of the tip or by the provision of a symmetrical or asymmetrical secondary angle of from 45° to 180°. This secondary angle is marked by angle x in FIG. 3*b*. A substantial rounding of the tip includes blades heaving at leant a tertiary angle. Suitable blades are illustrated in FIGS. 3*a*, 3*b*, 4 and 5. Preferably the blade is blunted by provision of a secondary angle of from 60° to 120° or by rounding. Most preferably the blade is blunted by provision of a secondary angle of 90°.

By cutting angle is meant the angle at the tip of the blade prior to any blunting. Preferably the cutting angle of the cutting blade is from 1 to 20 degrees, most preferably from 3° to 10°. The cutting angle is marked by angle y in FIG. 3*b*.

It is essential that the aspect of travel of ultrasound down the blade is approximately 90° to the cutting edge of the blade. A deviation of up to 10° either side of 90° is tolerable (ie. from 80° to 100°).

The cutting edge may be flat or may comprise teeth-like ridges.

The cutting blade may be of any length providing that the total length of the blade is a multiple of 0.5 of a wavelength. The length W of the blade is shown in FIG. 2.

The cutting of the food product is effected, inter alia, by localised heating at or close to the cut face and by the slicing action of the blade. The heat may result from internal damping eg. damping of the vibrational energy, or internal resistance eg. friction between the blade and the food product. The ultrasound concentrates heat at or close to the cut Face The ultrasonic system may be any conventional system and will typically comprise a press and a vibrating acoustic element consisting of an emitter, an amplifier and a sonotrode supplied by a high-frequency generator.

In one embodiment, the blade cuts and passes through the static article to be cut. In another embodiment, the article is cut by moving it towards the static, angled blade.

The blade may be vibrated at a frequency of between 18 kHz and 50 kHz.

Preferably, the blade can cut articles which are up to 100 mm thick.

Preferably the food product to be cut is at a temperature of from −5° C. to −25° C., most preferably from −8° C. to −15° C.

The food product may be frozen meat or poultry. Preferably the food product is frozen fish.

In the accompanying drawings FIGS. A & B are comparative illustrations whereas FIGS. 1–6 illustrate the invention;

BRIEF DESCRIPTION OF THE DRAWINGS

Figure A is a schematic view showing a cutting system in which the blade is flexed perpendicular to the cut face as, for example, in EP 353 415.

Figure B is a cross-section of a conventional knife-shaped blade tip having a cutting angle of 30°.

FIG. 1 is a schematic view showing a cutting system in which the blade is flexed parallel to the cut face.

DETAILED DESCRIPTION OF THE DRAWINGS

Figure 2:
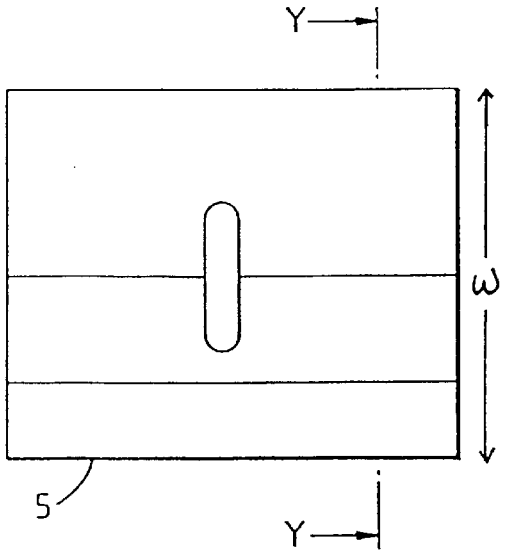
FIG. 2 is a side elevation of the cutting blade, where the cutting edge is labelled 5.
Figure 2:
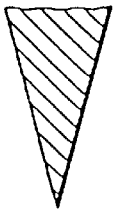
Figure 3A:
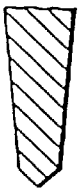
FIGS. 3*a*, 3*b*, 4 and 5 are cross-sections along the line Y—Y marked in FIG. 2, showing different types of significantly blunted blade tips.
Figure 3B:
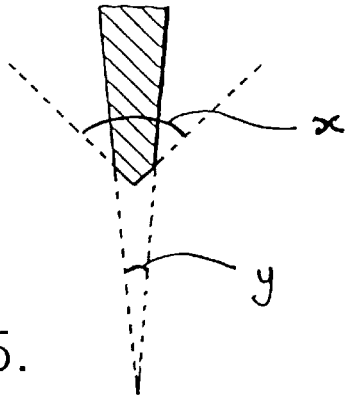

FIGS. 3*a* & 3*b* have a cutting angle y of 10° and a secondary angle x of 90°.

Figure 4:
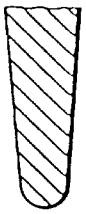
Figure 5:
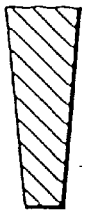

FIG. 4 has a cutting angle of 10° and a rounded tip,

FIG. 5 has a cutting angle of 10° and a secondary angle of 180°.

In Figure A a blade 2 is vibrated at an ultrasonic frequency perpendicular to the cut face 1 as illustrated by the directional arrows A⇆B, and on passage through the article 3 to be cut will excavate a cut 4 from the article, as the blade passes through the article in the direction X.

In FIG. 1 a blade 2 is vibrated at an ultrasonic frequency parallel to the cut face 1, and the blade passes through the article 3 to be cut in the direction X.

Figure 6:
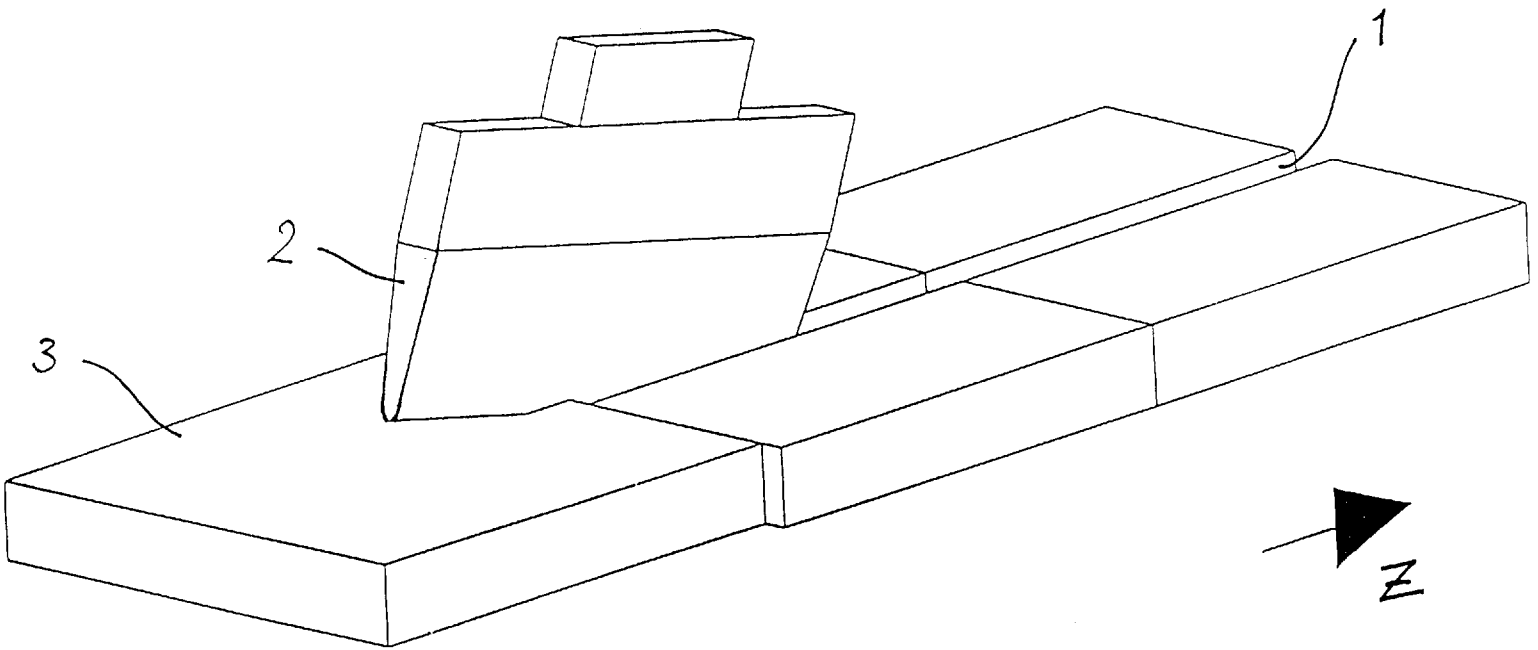
FIG. 6 is perspective, schematic view of a cutting system in which the article is moved towards the static blade.

In FIG. 6, a static, angled blade 2 is vibrated at ultrasonic frequency parallel to the cut face 1, and the article 3 is moved in direction Z towards the blade.

EXAMPLE 1

A frozen fish plank (+15° C.) of depth 22 mm and width 85 mm was ultrasonically cut into strips with blades of the form shown in FIGS. 3*a* and 3*b* (cutting angle 10°; secondary angle 90°). Two blade materials were tested and one being an aluminium alloy and the other a titanium alloy.

For both blades the cutting speed was 6 $mms^{-1}$ and after completing an experimental matrix of up to 1000 cuts the cutting edge was still in good condition.

The maximum cutting force at the velocity of 6 $mms^{-1}$ was approximately 16% of the load when the ultrasonics were turned off. The cutting losses were approximately 10% of those achieved with a bandsaw and the cut surfaces were smooth.

EXAMPLE 2

A frozen fish block (−15° C.) of depth 65 mm and width 60 mm was ultrasonically cut with blocks of the form shown in FIG. 3*a* and 3*b*. Titanium and aluminium alloys were used in the manufacture of the blades. After a matrix of experiments involving speed of blade of up to approximately 300 cuts the cutting edge was still in good condition. The maximum cutting force at a velocity of 6 $mms^{-1}$ was approximately 20% of that obtained with the ultrasonics off.

EXAMPLE 3

A frozen fish block (−10° C.) of depth 22 mm and width 85 mm was ultrasonically cut into strips with a titanium alloy blade of the form shown in FIGS. 3*a* and 3*b* (cutting angle 10°; secondary angles 90°).

For this blade the maximum cutting force at the velocity of 25 $mms^{-1}$ was 0.3 KN, and portions of good shape with a smooth cut surface were obtained.

The maximum cutting force at a velocity of 25 $mm^{-1}$ was approximately 35% of that obtained with the ultrasonics off.

COMPARATIVE EXAMPLE A

A frozen fish block (−15° C.) of depth 65 mm and width 60 mm was cut ultrasonically with a blade of the form shown in Figure B (knife-shaped blade with a cutting angle of 30°). The blade was made of Aluminium alloy. The cutting speed was approximately 5 $mm^{-1}$ and during preliminary trails the blade became damaged. The damage took the form of bending and fracture of the tip section of the blade.

COMPARATIVE EXAMPLE B

Comparative Example A was repeated except that the blade was made of a Titanium alloy, was knife-shaped and had a cutting angle of 10°.

The blade was again damaged.

We claim:

1. A process for cutting food products, said process comprising the steps of:

mounting a cutting blade having a blunted tip as a cutting edge on an ultrasonic sound system;

generating ultrasonic sound that travels through and along said cutting blade toward the blunted tip and wherein the aspect of travel of ultrasound through the blade is at an angle of approximately 90° to the cutting edge of the blade;

contacting the cutting edge of the cutting blade with a food product to be cut;

vibrating, at ultrasonic frequencies, said cutting blade in a motion parallel to a cut face of the food product; and cutting the food product with said cutting blade by localized heating at the cut face of the food product.

2. A process according to claim 1, wherein the cutting is at a cutting angle of from about 1° to about 20°.

3. A process according to claim 1, wherein the cutting is at a cutting angle of from about 30° to about 10°.

4. A process according to according to claim 1, which includes selecting, as the blade to be mounted, one wherein the tip of the cutting blade is significantly blunted by rounding of the tip.

5. A process according to claim 1, which includes selecting, as the blade to be mounted, one wherein the tip of the cutting blade is blunted by secondary angle of from about 60° to about 120°.

6. A process according to claim 1, which includes selecting, as the blade to be mounted, one wherein the tip of the cutting blade is blunted by a secondary angle of about 90°.

7. A process according to claim 1, wherein the temperature of the food product to be cut is from about −5° C. to about −25° C.

8. A process according to claim 1, wherein the temperature of the food product to be cut is from about −8° C. to about −15° C.

9. A process according to claim 1, wherein the food product is selected from the group consisting of frozen fish, meat and poultry.

10. A process according to claim 1, wherein the ultrasonic sound passes through and along said cutting blade toward the blunted tip at an angle of from about 80° to about 100° to said cutting edge.

11. A process according to claim 1, wherein the ultrasonic sound passes through and along said cutting blade toward the blunted tip at an angle of about 90° to said cutting edge.

12. A process according to claim 1, wherein includes selecting, as the blade to be mounted, one wherein the tip of the cutting blade is significantly blunted by a secondary angle of from about 45° to about 180°.

* * * * *